US008894457B1

(12) United States Patent
Crozier

(10) Patent No.: US 8,894,457 B1
(45) Date of Patent: Nov. 25, 2014

(54) SURFER LEASH FOR A STAND UP PADDLE BOARD

(76) Inventor: Peter Crozier, Makawao, HI (US)

( * ) Notice: Subject to any disclaimer, the term of this patent is extended or adjusted under 35 U.S.C. 154(b) by 147 days.

(21) Appl. No.: 13/597,455

(22) Filed: Aug. 29, 2012

(51) Int. Cl.
*B63B 35/79* (2006.01)

(52) U.S. Cl.
USPC ..... 441/75

(58) Field of Classification Search
CPC ..... B63B 2035/794; B63B 35/73; A01K 27/003; A01K 27/005
USPC ..... 441/74, 75, 65
See application file for complete search history.

(56) References Cited

U.S. PATENT DOCUMENTS

| | | | | |
|---|---|---|---|---|
| 2,602,233 | A * | 7/1952 | Irving | 33/756 |
| 3,802,011 | A | 4/1974 | Castagnola | |
| 3,805,667 | A * | 4/1974 | Orser | 87/6 |
| 3,931,656 | A | 1/1976 | Thomson | |
| 4,041,562 | A | 8/1977 | Nealy | |
| 4,044,415 | A | 8/1977 | Wood | |
| 4,479,785 | A | 10/1984 | Tugwood et al. | |
| 4,509,233 | A * | 4/1985 | Shaw | 24/136 R |
| 4,610,634 | A * | 9/1986 | Kimura | 441/75 |
| 5,098,324 | A * | 3/1992 | Isono et al. | 441/75 |
| 5,931,076 | A * | 8/1999 | Ryan | 87/8 |
| 6,471,560 | B2 * | 10/2002 | Kerckhoff | 441/75 |
| 7,331,311 | B2 * | 2/2008 | Hurwitz | 119/795 |
| 2008/0160848 | A1 * | 7/2008 | French | 441/75 |
| 2010/0133306 | A1 * | 6/2010 | Monroe | 224/219 |

* cited by examiner

*Primary Examiner* — Stephen Avila
*Assistant Examiner* — Anthony Wiest
(74) *Attorney, Agent, or Firm* — Robert C. Montgomery; Montgomery Patent & Design

(57) ABSTRACT

A surfer leash for a stand up paddle boards includes a plurality of strands that are woven together for increased strength. Such increased strength is necessary when dealing with the heavier and larger boards typically used in stand up paddle boarding. The leash is applied and worn around a surfer's ankle at one end and attached to the stand up paddle board at an opposing end.

12 Claims, 4 Drawing Sheets

SURFER LEASH FOR A STAND UP PADDLE BOARD

RELATED APPLICATIONS

Not Applicable.

FIELD OF THE INVENTION

The present invention relates generally to devices for tethering a person to a surfboard, and in particular, to a surfer leash for tethering a surfer to a stand up paddle board.

BACKGROUND OF THE INVENTION

Very few leisure time activities rival that of spending a warm summer day at the beach and on the water. Among the many activities that one can enjoy at the beach, swimming and surfing among the waves is the most popular. Over the years, there have been several new twists added to the surfing experience. One (1) of the more recent forms of entertainment is that of the stand-up paddle board. It allows surfers to perform different routines and functions than those afforded by a conventional surfboard.

Various types of tethers are commonly used to attach the surfboard to the surfer to prevent the surfer from being separated from the surfboard after falling from the surfboard. These tethers are commonly attached to the rear of the surfboard at one end and to an ankle of the surfer at the other end. The tether is a usually made of a flexible, non-elastic material that is long enough to provide the surfer freedom of movement while atop the surfboard and to remain a safe distance from the surfboard in situations where the surfer falls.

A disadvantage of these types of tethering devices is that they are prone to snap due to the force exerted on the surfer's ankle as the surfboard is accelerated away from the surfer by a wave. Moreover, the stand up paddle board is of a heavier and larger design than a conventional surfboard. As such, attachment tethers typically used to attach the surfer to the surfboard to prevent loss are more prone to snapping with stand up paddle boards which can lead to injury of the surfer.

SUMMARY OF THE INVENTION

The inventor has recognized the aforementioned inherent problems and lack in the art and observed that there is a need for a surfer's leash for stand up paddle boards that can be easily attached to the surfer and the board without the worry of breakage. The development of the present invention substantially departs from the conventional solutions and in doing so fulfills this need.

In order to address this need, an aspect of the present invention is to provide stand up paddle boarders the ability to remain connected to their stand up paddle board at all times thus eliminating potential loss in a manner which is quick, easy, and effective.

In accordance features and aspects of certain embodiments, the surfer leash for a stand up paddle board includes a cord assembly comprising at least three (3) intertwining cords, a rail saver assembly which is movably connected to a first end of the cord assembly by a first swivel connector assembly and which is adapted for attachment to the stand up paddle board, and a cuff assembly which is movably connected to a second end of the cord assembly by a second swivel connector assembly and which adapted for attachment to a human ankle.

In accordance with other features and aspects of other embodiments, the first swivel connector assembly includes a first connector housing affixed around the first end of the cord assembly for binding first ends of the cords together. A first swivel feature protrudes outwardly from a closed end of the first connector housing and a first swivel feature holder is attached to the rail-saver assembly for connection to the first swivel feature. The second swivel connector assembly includes s a second connector housing affixed around the second end of the cord assembly for binding second ends of the cords together. A second swivel feature protrudes outwardly from a closed end of the second connector housing and a second swivel feature holder is attached to the cuff assembly for connection to the second swivel feature.

In accordance with other features and aspects of other embodiments, the first swivel feature holders includes a first socket having an open top configured to retain a spherical end of the first swivel feature, such that the first swivel feature holder is angularly movable relative to the first connector housing. The second swivel feature holders includes a second socket having an open top configured to retain a spherical end of the second swivel feature, such that the second swivel feature holder is angularly movable relative to the second connector housing.

In accordance with other features and aspects of certain embodiments, the rail-saver assembly includes a flexible strap loop having opposing first and second ends releasably fastened together and a tether cord that is removably connected within the strap loop and is adapted for attachment to a leash plug of the stand up paddle board. A strap loop safety strap is provided which includes an affixed end that is affixed to the strap loop first end and an opposing free end that is releasably fastened to the strap loop second end when the strap loop first and second ends are fastened together. A strap loop pull tab is also affixed to and extends outwardly from the strap loop safety strap free end.

In accordance with other features and aspects of certain embodiments, the cuff assembly includes a flexible collar having opposing first and second ends releasably fastened together. A collar safety strap is provided which includes an affixed end that is affixed to the collar first end and an opposing free end that is releasably fastened to the collar second end when the collar first and second ends are fastened together. A collar pull tab is affixed to and extends outwardly from the collar safety strap free end.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
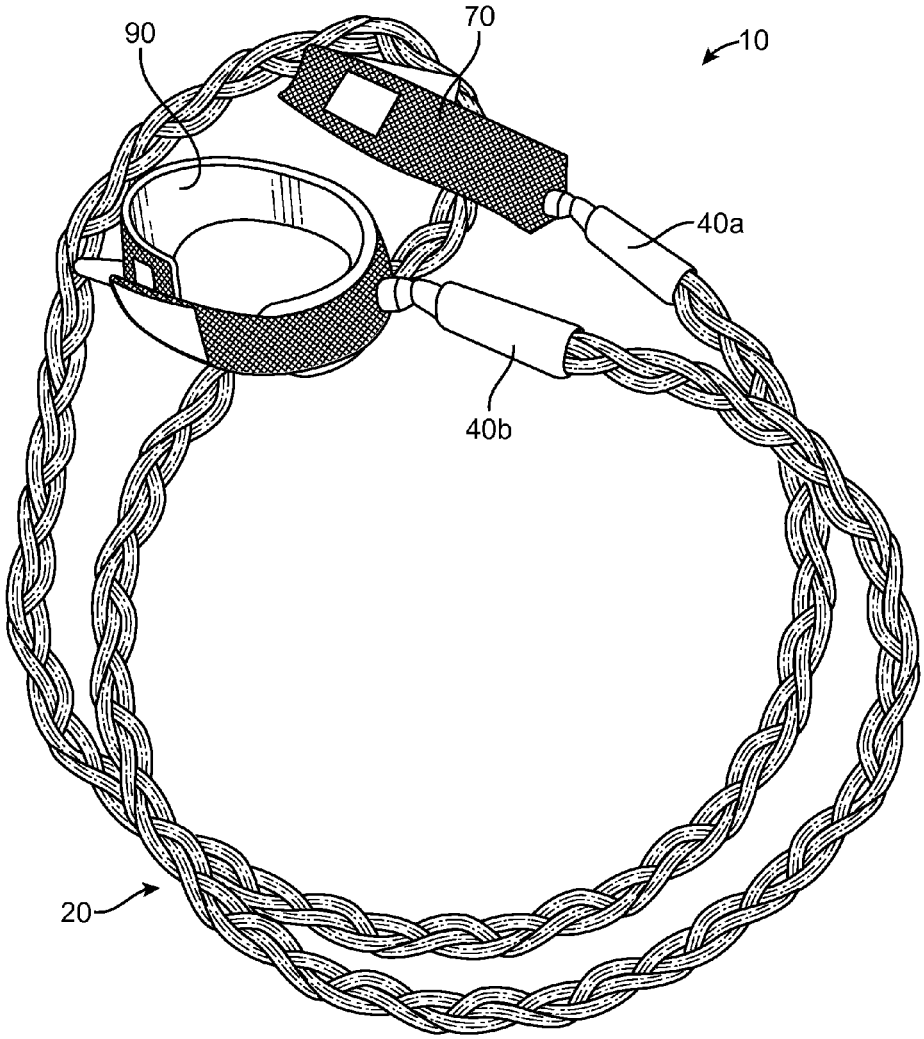
FIG. 1 is a perspective view of a surfer leash for a stand up paddle board, in accordance with the present invention.

10 surfer leash for a stand up paddle board
20 cord assembly
24 cord
28 sheathing
40*a* first swivel connector assembly
40*b* second swivel connector assembly
42 connector housing
44 swivel feature holder
46 inner bore
48 swivel feature
50 socket
52 keeper feature
70 rail-saver assembly
71 strap aperture
72 strap loop
74 first safety strap
76 pull tab
77 strap retention feature
80 tether cord
90 cuff assembly
91 collar aperture
92 collar
93 padding
94 attachment strap
97 collar retention feature
98 second safety strap
190 hook-and-loop fastener
200 leash plug
210 stand up paddle board

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

It can be appreciated that, although such terms as first, second, etc. may be used herein to describe various elements, these elements should not be limited by these terms. These terms are only used to distinguish one element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one or more unstated elements, steps or functions. Relative terms such as "front" or "rear" or "left" or "right" or "top" or "bottom" or "below" or "above" or "upper' or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 4, depicting a surfer leash for a stand up paddle board, identified generally by reference to an apparatus 10, where like reference numerals represent similar or like parts. In accordance with the teachings of the present disclosure, the apparatus 10 provides an attachable personal leash for use upon a large stand up paddle board 210, such as those used in the sport of surfing. The apparatus 10 is especially useful when utilized with heavier and larger boards, such as those used in stand up paddle board surfing. The use of the apparatus 10 provides stand up paddle board surfers an ability to remain connected to their board 210 at all times, thus reducing potential loss of surfing equipment.

Referring to FIG. 1, the apparatus 10 provides secure attachment of a surfer to the stand up paddle board 210 through three (3) cords 24 which are braided together for increased strength and forming a cord assembly 20 approximately nine feet (9 ft.) long. The cord assembly 20 is a structure or pattern formed by intertwining three (3) or more cords 24 of a generally flexible material. The braided cord assembly 20 is long and narrow, with each component cord 24 functionally equivalent in zigzagging forward through an overlapping mass of the other cords 24. Each cord 24 is preferably made using high tensile strength urethane cord; however, other flexible and stretchable materials such as bungee-cord, surgical tubing, or the like can also be used with equal benefit, and as such should not be interpreted as a limiting factor of the present disclosure. In certain embodiments, each cord 24 is formed by a plurality of intertwined strands of high tensile strength material. The apparatus 10 also includes a rail-saver assembly 70 for attachment of a first end of the cord assembly 20 to the stand up paddle board 210 and a cuff assembly 90 for attachment of an opposing second end of the cord assembly 20 around the user's ankle. Each individual cord 24 of the braided cord assembly 20 is provided with tight-fitting transparent sheathing 28 extending from end to end which terminates just above a connector housing 42 for durability and aesthetic purposes (see FIG. 4). However, other types of materials can be used for the sheathing 28 with equal benefit.

Figure 2:
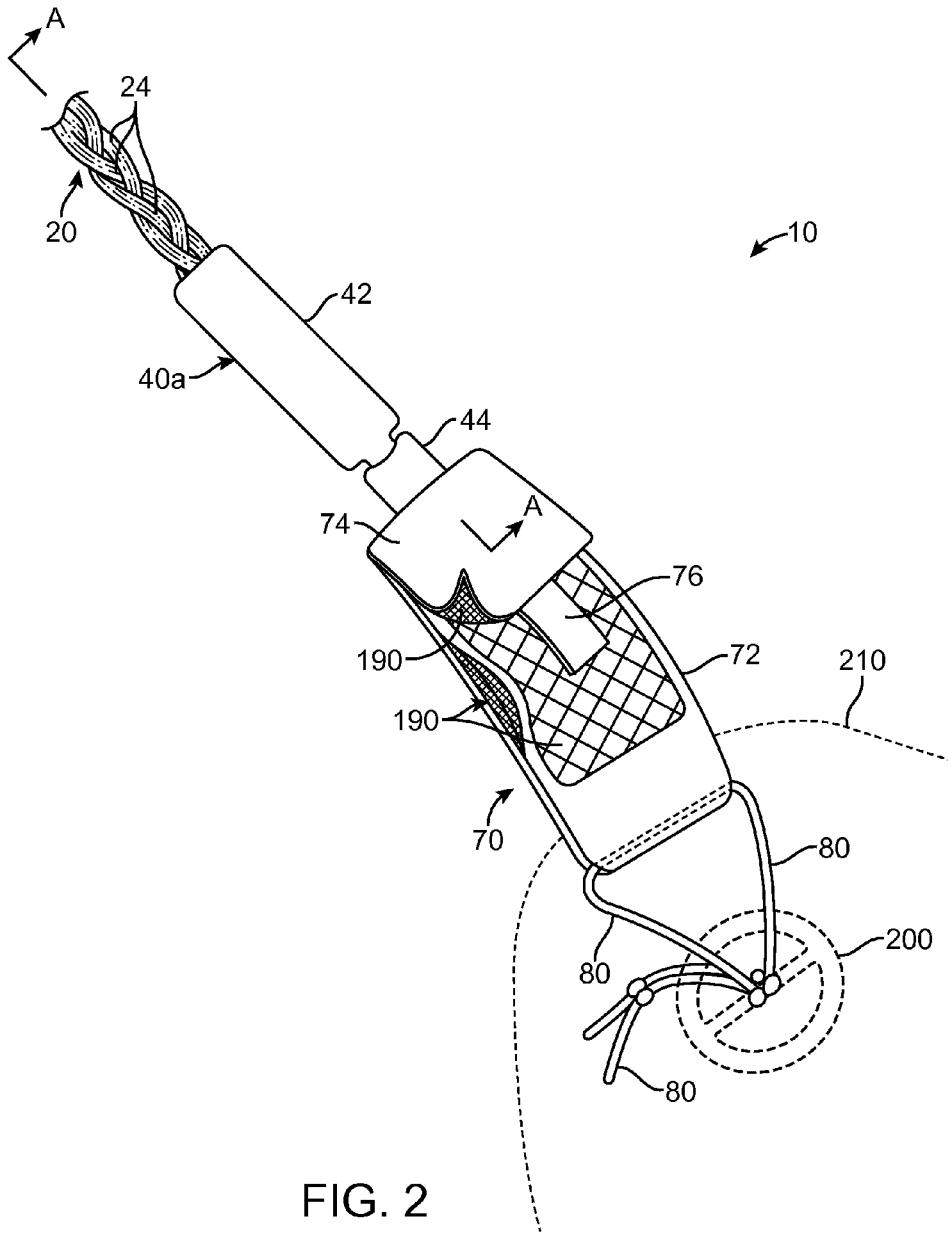
FIG. 2 is a close-up view of a rail-saver assembly of the surfer leash for a stand up paddle board.

Referring to FIG. 2, the apparatus 10 provides for removable attachment of the distal first end of the cord assembly 20 to the stand up paddle board 210 by a combination of interconnected major components, including a first swivel connector assembly 40*a*, the rail-saver assembly 70, and a tether cord 80. The first swivel connector assembly 40*a* provides for flexible angular attachment of the cord assembly 20 to a strap loop 72 of the rail-saver assembly 70. The first swivel connector assembly 40*a* includes a swivel feature holder 44 that is securely attached to an end portion of the strap loop 72. The strap loop 72 is formed of a strong textile strapping material, such as, neoprene, nylon, or equivalent materials being assembled using conventional textile processes.

During installation of the apparatus 10 to the board 210, the strap loop 72 is looped through the tether cord 80 and fastened upon itself by inwardly facing and communicating sections of hook-and-loop fasteners 190. The strap loop 72 is double-secured using a first safety strap 74 which entraps and fastens to the strap loop 72 using additional hook-and-loop fasteners 190. The first safety strap 74 includes an integral and outwardly extending pull tab 76 for quick release of the rail-saver assembly 70 from the tether cord 80 by the user. The tether cord 80 is a closed loop of nylon cord or equivalent material, which is looped and tied around a leash plug 200 of the stand up paddle board 210.

Figure 3:
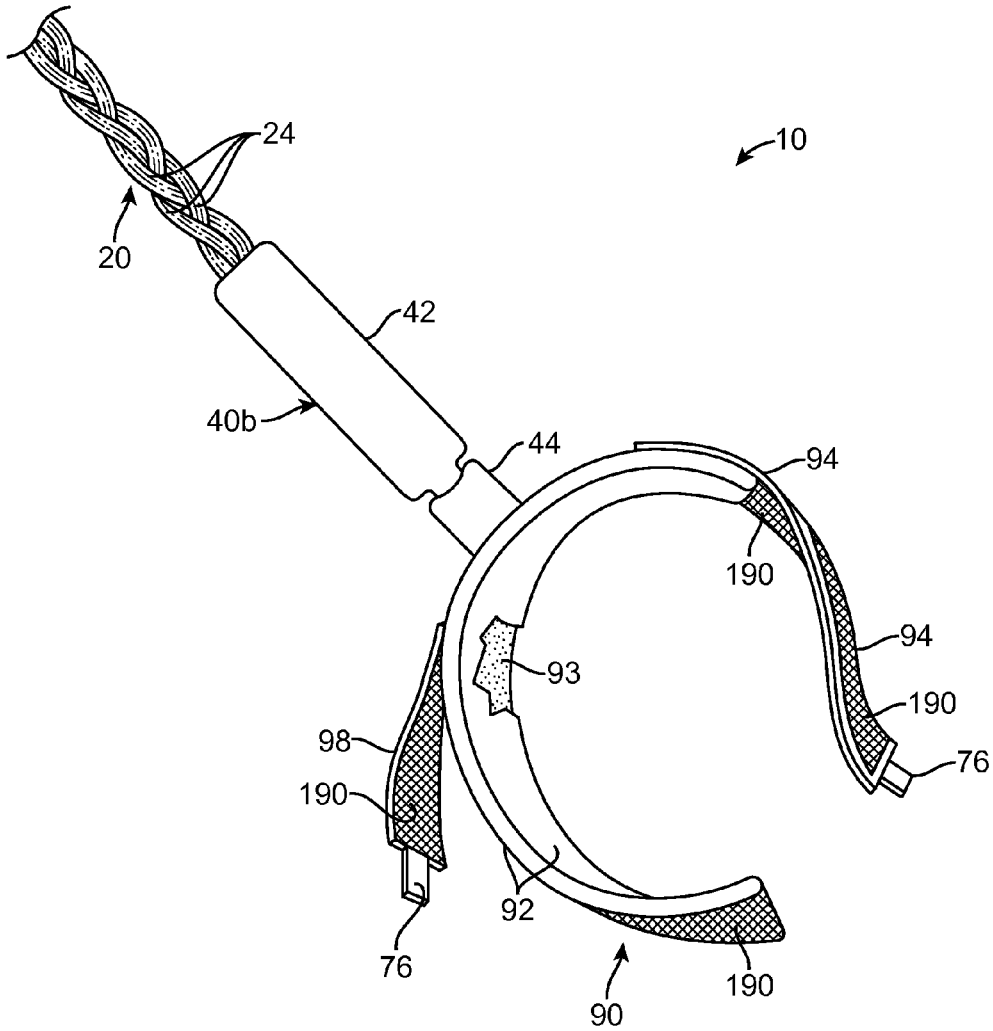
FIG. 3 is a close-up view of a cuff assembly of the surfer leash for a stand up paddle board; and, FIG. 4 is a section view of a swivel connector assembly of the surfer leash for a stand up paddle board taken along section line A-A of FIG. 2.

Referring to FIG. 3, the cuff assembly 90 provides secure attachment of the proximal second end of the cord assembly 22 to the surfer's ankle area by a second swivel connector assembly 40*b* and a padded collar 92. In a similar manner as the previously described rail-saver assembly 70, a swivel feature holder 44 of the second swivel connector assembly 40*b* is securely attached to an end of the collar 92. The collar 92 is preferably fabricated from a strong textile strapping material, such as, neoprene, nylon, or equivalent textile materials and filled with urethane foam or other rubber padding 93 being assembled using conventional textile processes. The collar 92 is a ring-shaped structure which preferably encompasses the user's ankle area; however, it can be appreciated that the collar 92 can be easily adapted for use around an upper calf area of the user's leg with equal benefit, and as such should not be interpreted as a limiting factor of the present disclosure.

The collar 92 is secured around the user's ankle area by an attachment strap 94 having an inner surface with integral sections of hook-and-loop fasteners 190 which are fastened to mating sections of hook-and-loop fasteners 190 along the outer surface of the collar 92. Additional securement of the cuff assembly 90 around the user's ankle is obtained by use of a second safety strap 98 which encompasses over an open front section of the attachment strap 94 using inwardly facing hook-and-loop fasteners 190 in a similar manner as the previously described rail-saver assembly 70. The second safety strap 98 also includes a pull tab 76 for quick removal.

Figure 4:
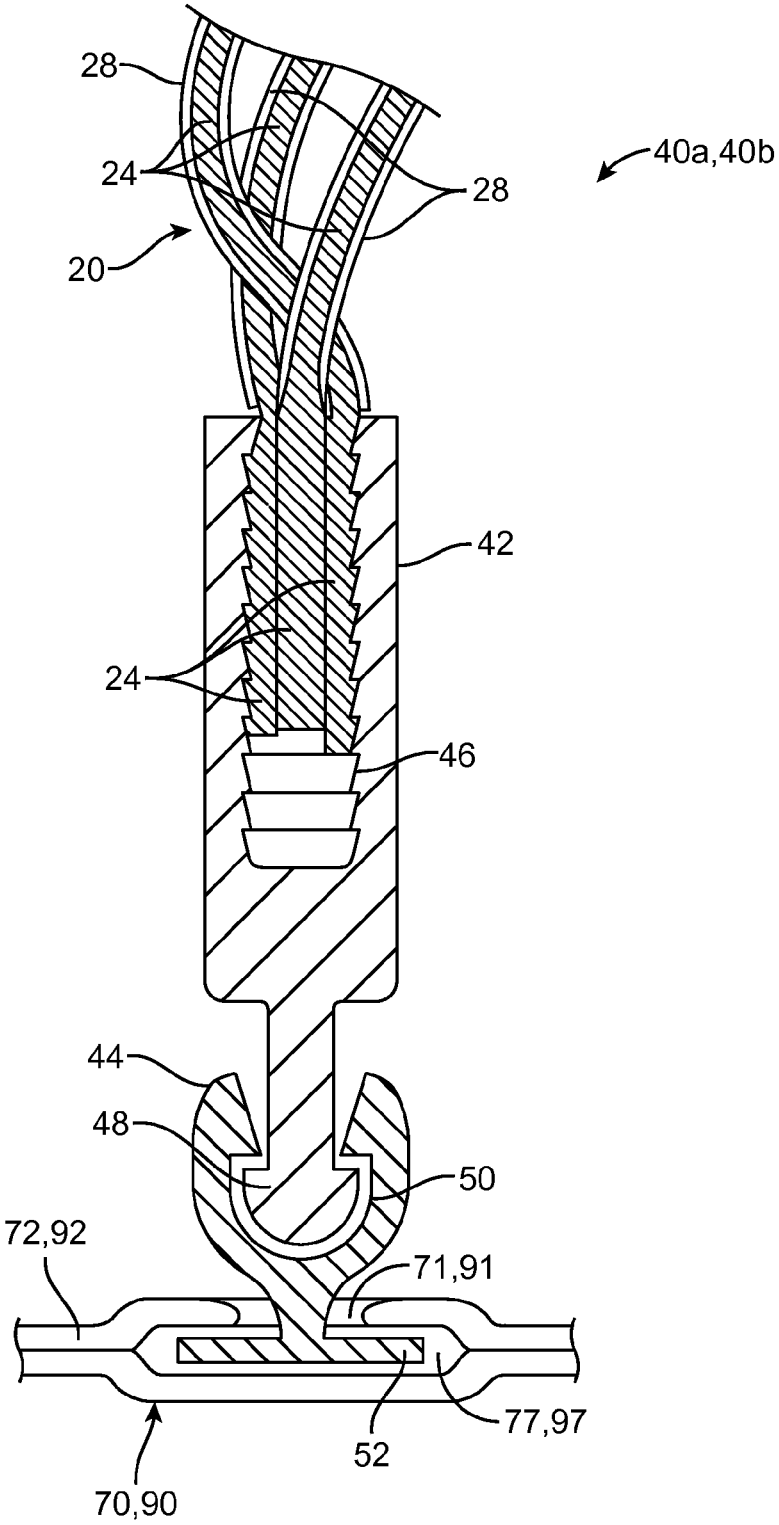

Referring to FIG. 4, the first swivel connector assembly 40*a* and second swivel connector assembly 40*b* provide identical form and function with regards to respective rail-saver assembly 70 and cuff assembly 90 of the apparatus 10. The swivel connector assemblies 40*a*, 40*b* provide strong mechanical attachment of the cord assembly 20 while also providing a swiveling angular connection of the cord assembly 20 to respective rail-saver assembly 70 and cuff assembly 90 attachments. Each swivel connector assembly 40*a*, 40*b* includes a cylindrical connector housing 42 having an outwardly protruding spherical swivel feature 48, a swivel feature holder 44, and a keeper feature 52. The connector housing 42 includes a knurled or toothed inner bore 46 which provides insertion and permanent mechanical retention of the respective end of the cord assembly 20 therewithin. It is envisioned that the connector housing 42 also includes a means of clamping around the cords 24, such as by crimping, adhesives, or similar fastening techniques.

As best seen in FIG. 4, the integral, protruding swivel feature 48 includes a spherical or semi-spherical end which is insertably entrapped within a socket 50 of the cup-shaped swivel feature holder 44, thereby enabling relative angular movement of the cord assembly 20 relative to the swivel feature holder 44. Each swivel feature holder 44 includes the integral "T"-shaped keeper feature 52 which is securely captivated within the strap retention feature 77 and the collar retention feature 97 of respective strap loop 72 and collar 92 of the apparatus 10 using attachment methods such as sewing, adhesives, fasteners, or the like. The strap retention feature 77 and collar retention feature 97 are preferably formed by open areas within the interior of the respective strap loop 72 and collar 92, such as by unaffixed portions of two (2) affixed layers of material. An aperture 71, 91 of each strap assembly 70 and collar assembly 90, respectively, permits the insertion of the keeper feature 52 into the strap retention feature 77 and collar retention feature 97, respectively.

The swivel connector assemblies 40*a*, 40*b* are envisioned to be made using rugged corrosion-resistant materials such as stainless steel, brass, composite plastic, or the like, being capable of withstanding tensile and torsional forces associated with a surfing activity.

It can be appreciated by one skilled in the art that other styles and configurations of the present invention can be easily incorporated into the teachings of the present disclosure and only certain particular configurations have been shown and described for purposes of clarity and disclosure and not by way of limitation of scope.

In accordance with the principles of the present invention, the apparatus 10 can be utilized by the user in a simple and effortless manner with little or no training in general accordance with FIG. 1 through FIG. 4. It can be appreciated that the steps required to utilize the apparatus 10, as described, can performed in alternative order and as such should not be viewed as a limiting factor.

A model of the apparatus 10 having a desired length cord assembly 20 is procured. The tether cord 80 is attached to the leash plug 200 of the stand up paddle board 210 by routing the tether cord 80 under the post-portion of the leash plug 200 and tying in a conventional manner. The strap loop 72 is looped through the tether cord 80 and is folded and attached against itself via the hook-and-loop fasteners 190. The strap loop 72 is double-secured in position by folding down and fastening the first safety strap 74 over an end portion of the strap loop 72 via respective hook-and-loop fasteners 190.

Following attachment of the apparatus 10 to the board 210, the user proceeds to a surfing area such as a beach. The cuff assembly 90 is fastened to the user's ankle area by wrapping the collar 92 around the ankle and is secured by wrapping and affixing the strap 94 against the collar 92 via respective hook-and-loop fasteners 190. The second safety strap 98 of the cuff assembly 90 is fastened to a top surface of the attachment strap 94 via respective hook-and-loop fasteners 190.

An alternative method of attaching the apparatus 10 to the user would be to utilize the cuff assembly 90 around an upper calf area of the user, and utilizing the apparatus 10 as previously described.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A surfer leash adaptable for a stand up paddle board comprising:

a cord assembly comprising a first end and an opposed second end, said cord assembly further comprising at least three intertwining cords;

a rail saver assembly movably connected to said first end of said cord assembly by a first swivel connector assembly and adapted for attachment to said stand up paddle board, said rail saver assembly comprising:

a flexible rail saver strap comprising a first end portion, a second end portion opposite said first end portion, an inner surface, and an outer surface;

a first hook-and-loop fastener disposed on said inner surface of said first end portion of said rail saver strap;

a second hook-and-loop fastener disposed on said inner surface of said second end portion of said rail saver strap, said first and second hook-and-loop fasteners engage to connect said first end portion to said second end portion of said rail saver strap;

a third hook-and-loop fastener disposed on said outer surface of said first end portion of said rail saver strap;

a first safety strap affixed to and extending outwardly from an end of said second end portion of said rail saver strap, said first safety strap comprising an inner surface and an outer surface;

a fourth hook-and-loop fastener disposed on said inner surface of said first safety strap, said third and fourth hook-and-loop fasteners engage to connect said first safety strap to said first end portion of said rail saver strap when said first end portion and said second end portion of said rail saver strap are connected together; and, a cuff assembly movably connected to said second end of said cord assembly by a second swivel connector assembly and adapted for attachment to a human ankle, said cuff assembly comprising:

a flexible cuff strap comprising a first end portion, a second end portion opposite said first end portion, an inner surface, and an outer surface;

a fifth hook-and-loop fastener disposed on said inner surface of said first end portion of said cuff strap;

a sixth hook-and-loop fastener disposed on said outer surface of said second end portion of said cuff strap, said first and second hook-and-loop fasteners engage to connect said first end portion to said second end portion of said cuff strap;

a seventh hook-and-loop fastener disposed on said outer surface of said first end portion of said cuff strap;

a second safety strap affixed to and extending from said outer surface of said cuff strap near said second end portion of said cuff strap; a cuff pull tab affixed to and extending outwardly from an end of said second end portion of said cuff strap; and an eighth hook-and-loop fastener disposed on said inner surface of said second safety strap, said seventh and eighth hook-and-loop fasteners engage to connect said second safety strap to said first end portion when said first end portion and said second end portion of said cuff strap are connected together.

2. The leash of claim 1, wherein each of said cords is formed by a plurality of intertwined strands of cord material.

3. The leash of claim 1, wherein each cord of said at least three intertwining cords comprises a transparent sheathing applied over an exterior thereof and extending between said first and second swivel connector assemblies.

4. The leash of claim 1, wherein:

said first swivel connector assembly comprises:

a first connector housing affixed around said first end of said cord assembly for binding first ends of said cords together;

a first swivel feature protruding outwardly from a closed end of said first connector housing; and a first swivel feature holder attached to said rail-saver assembly for connection to said first swivel feature; and, said second swivel connector assembly comprises:

a second connector housing affixed around said second end of said cord assembly for binding second ends of said cords together;

a second swivel feature protruding outwardly from a closed end of said second connector housing; and a second swivel feature holder attached to said cuff assembly for connection to said second swivel feature.

5. The leash of claim 4, wherein:

said first swivel feature holders comprises a first socket having an open top configured to retain a spherical end of said first swivel feature such that said first swivel feature holder is angularly movable relative to said first connector housing; and, said second swivel feature holders comprises a second socket having an open top configured to retain a spherical end of said second swivel feature such that said second swivel feature holder is angularly movable relative to said second connector housing.

6. The leash of claim 1, wherein said rail saver assembly further comprises:

a tether cord removably connected between said connected together first end portion and second end portion of said rail saver strap and adapted for attachment to a leash plug of said stand up paddle board;

and, a rail saver pull tab affixed to and extending outwardly from an end of said second end portion of said rail saver strap.

7. A surfer leash adaptable for a stand up paddle board comprising:

a cord assembly comprising a first end and an opposed second end, said cord assembly further comprising at least three intertwining cords;

a first connector housing affixed around said first end of said cord assembly for binding first ends of said cords together;

a first swivel feature protruding outwardly from a closed end of said first connector housing;

a first swivel feature holder movably connected to said first swivel feature, said first swivel feature holder comprising a first T-shaped keeper feature opposite said first swivel feature;

a flexible rail saver strap comprising a first retention feature defining an opening configured to retain said first keeper feature for connection of said first swivel feature holder to said rail saver strap, said rail saver strap further comprising opposing first and second end portions releasably connected together and adapted for attachment to said stand up paddle board, said rail aver strap further comprising;

a first safety strap affixed to and extending outwardly from said second end portion of said rail saver strap and releasably connected to said first end portion of said rail saver strap when said first and second end portions of said rail saver strap are connected together;

a rail saver pull tab affixed to and extending outwardly from said second end portion of said rail saver strap;

a tether cord removably connected within said rail saver strap and adapted for attachment to a leash plug of said stand up paddle board;

a second connector housing affixed around said second end of said cord assembly for binding second ends of said cords together;

a second swivel feature protruding outwardly from a closed end of said second connector housing;

a second swivel feature holder movably connected to said second swivel feature, said second swivel feature holder comprising a second T-shaped keeper feature opposite said second swivel feature;

a flexible cuff strap comprising a second retention feature defining an opening configured to retain said second keeper feature for connection of said second swivel feature holder to said cuff strap, said cuff strap further comprising opposing first and second end portions releasably connected together and adapted for attachment to a human ankle;

a second safety strap affixed to said cuff strap near said second end portion of said cuff strap and releasably connected to said first end portion of said cuff strap when said first and second end portions of said cuff strap are connected together; and, a cuff pull tab affixed to and extending outwardly from said second end portion of said cuff strap.

8. The leash of claim 7, wherein:

said first swivel feature holders comprises a first socket having an open top configured to retain a spherical end of said first swivel feature such that said first swivel feature holder is angularly movable relative to said first connector housing; and, said second swivel feature holders comprises a second socket having an open top configured to retain a spherical end of said second swivel feature such that said second swivel feature holder is angularly movable relative to said second connector housing.

9. The leash of claim 8, wherein said first and second connector housing each comprises a tubular member having a hollow interior with a toothed inner bore for contact with said cord assembly ends.

10. The leash of claim 9, wherein each of said cords comprises a transparent sheathing applied over an exterior thereof and extending between said first and second swivel connector assemblies.

11. The leash of claim 10, wherein each of said cords is formed by a plurality of intertwined strands of cord material.

12. The leash of claim 10, wherein said first and second connector housings are crimped on said cord assembly ends.

* * * * *